United States Patent [19]

Terry

[11] 4,010,801

[45] Mar. 8, 1977

[54] METHOD OF AND APPARATUS FOR IN SITU GASIFICATION OF COAL AND THE CAPTURE OF RESULTANT GENERATED HEAT

[75] Inventor: Ruel C. Terry, Denver, Colo.

[73] Assignee: R. C. Terry, Denver, Colo.

[22] Filed: Oct. 6, 1975

[21] Appl. No.: 619,562

Related U.S. Application Data

[62] Division of Ser. No. 510,409, Sept. 30, 1974, abandoned.

[52] U.S. Cl. ..... 166/261; 48/DIG. 6; 166/117.5; 166/223; 165/45

[51] Int. Cl.[2] ..... E21C 43/00; E21B 43/24

[58] Field of Search ..... 48/DIG. 6; 166/251, 166/256, 257, 260, 261, 117.5, 223; 175/12

[56] References Cited

UNITED STATES PATENTS

| | | | |
|---|---|---|---|
| 1,867,758 | 7/1932 | Ranney | 48/DIG. 6 |
| 1,913,395 | 6/1933 | Karrick | 48/DIG. 6 |
| 2,695,163 | 11/1954 | Pearce et al. | 166/261 |
| 2,786,660 | 3/1957 | Alleman | 175/12 |
| 2,788,956 | 4/1957 | Peuere et al. | 175/12 |
| 3,298,434 | 1/1967 | Graham | 166/261 |
| 3,563,606 | 2/1971 | Sears | 175/12 |

*Primary Examiner*—Ernest R. Purser

[57] ABSTRACT

A method of in situ gasification of coal includes the steps of releasing reactant materials in a coal bed in a manner such that the reactants are directly exposed to the burning face of a coal bed under preselected temperatures and pressures whereby the incomplete combustion of the coal is affectively controlled. In one preferred form of the method, the heat generated from the combusted materials is captured and separated from the recovered gas so that the heat can be converted to other forms of energy separately from the recovered gas.

4 Claims, 3 Drawing Figures

METHOD OF AND APPARATUS FOR IN SITU GASIFICATION OF COAL AND THE CAPTURE OF RESULTANT GENERATED HEAT

This is continuation, division, of application Ser. No. 510,409 filed 9-30-74 now abandoned.

The apparatus used in carrying out the method of the present invention includes in one preferred form an elongated flexible conduit which is inserted into a well bore in communication with an underground coal bed and means for advancing the conduit along the coal bed so that gasifying agents can be emitted through a nozzle on the leading end of the conduit immediately adjacent to the burning face of the coal bed. The gasifying agents can be emitted from the nozzle at selected velocities, allowing the agents to be delivered to inaccessible faces of the burning bed when necessary. In another embodiment of the apparatus, rupturable containers of gasifying agents are adapted to be deposited into an inclined coal bed so that the containers can roll along the inclined bed to the burning face of the coal bed before being ruptured by heat to release the gasifying agents at the burning face of the coal bed. In either embodiment of the apparatus, heat transfer means may be provided in direct exposure to the hot recovered gas to absorb heat from the gas and thereby separate the heat from the gas so that the heat can be transferred separately from the recovered gas for use in generating other forms of energy.

BACKGROUND OF THE INVENTION

General

For more than 100 years serious efforts have been made to gasify coal in situ from laboratory tests to full scale projects. Most projects failed as commercial ventures due to intense competition from petroleum and natural gas. Others failed due to technical deficiencies in processes.

The inability of the petroleum industry to keep pace with the demand for energy has focused world wide attention to future projects for in situ coal gasification. In the coal industry generally, it is expected that more emphasis will be placed on underground gasification of coal due, in part, to environmental requirements that severely restrict or prevent strip mining operations.

The ideal project for in situ gasification of coal would eliminate the perils of man power underground and would provide a clean, high heat content gas suitable for commercial and industrial uses. There are sufficient known coal deposits in the United States to provide total energy requirements for hundreds of years. Unfortunately, a substantial amount of these deposits are located at depths considered uneconomical for conventional underground mining. Improved new methods of in situ coal gasification can unlock the energy of deeply buried coal deposits.

Combustion of Hydrocarbons

The primary use of hydrocarbons fuels is in some method of combustion to release energy in the form of heat, whether it be in an automobile engine, a furnace to generate steam or hot air or the like. In the combustion process, oxygen is supplied to the fuel and the temperature is raised above ignition temperature resulting in rapid oxidation or burning, and a consequent rapid release of heat. Ignition temperatures in air are on the order of 1250° F for natural gas (methane); 1200° F for carbon monoxide; 1080° F for hydrogen; 925° F for anthracite coal; 820° F for bituminous coal; and 600° F for crude petroleum. The most common source of oxygen is air which contains 21% oxygen by volume, with the remainder substantially all nitrogen. In the ideal complete combustion process using air, hydrogen from the hydrocarbon fuel unites with oxygen to form water vapor, and carbon unites with oxygen to form carbon dioxide. Nitrogen from the injected air mainly robs heat from the process as it exits at exhaust or stack gas temperature. Thus the exit gases have given up their ability to oxidize further and are useless as a fuel. In actual practice, available oxygen is virtually impossible to use fully, therefore, exit gases also contain quantities of carbon monoxide, hydrogen, oxygen, methane, illuminants and the like.

Gasification of Coal

Coal is a solid hydrocarbon that contains extraneous matter such as moisture (water) and impurities (ash). For in situ gasification of coal, it is desirable to remove exit gases with the highest heat content possible, using moisture content to enhance the exit gases, and to leave the ash in place.

In burning coal above ground for its heat content, combustion is accomplished in two modes:

(1) heat of the fire drives of the volatile content which burns as a gas above the fuel bed, and 2. the residual fixed carbon burns as coke upon the hearth or grate.

For in situ gasification, it is desirable to remove the lighter fractions of the volatile content as unburned gases mixed in the exit gases and to inject suitable gasifyers to decompose the burning fixed carbon into carbon monoxide, hydrogen and methane. For in situ gasification it is undesirable to permit the carbon monoxide to burn further into carbon dioxide, or for hydrogen to burn into water vapor, and for methane to burn into carbon dioxide and water. Therefore, carefully controlled incomplete combustion is essential to efficient in situ gasification of coal.

Coal Gasification Products

The content of exit gases from in situ gasification of coal is very important to the commercial success of a project, because the object is to recover exit gases with the highest heat content without the necessity of separating out the gases with no useful calorific content. Methane ($CH_4$) is the most desirable of the exit gases because of its clean burning characteristics and high heat content (about 1,000 BTU per standard cubic foot). Carbon monoxide (CO) with a heat content of 315 BTU per standard cubic foot is desirable as is free hydrogen (H) with a heat content of 320 BTU per standard cubic foot. Undesirable exit gases include free nitrogen ($N_2$) and carbon dioxide ($CO_2$) because they are incapable of oxidation and, therefore, have no useful heat or calorific content as pipeline gases. The inefficiencies of using atmospheric air as the gasifier of coal are readily apparent in this typical analysis of exit gases:

| Component | Volume % |
|---|---|
| Carbon Dioxide | 10.6 |
| illuminants | 0.2 |
| hydrogen | 8.7 |
| oxygen | 0.6 |
| carbon monoxide | 10.4 |
| methane | 2.0 |
| nitrogen | 67.5 |

This results in a composite exit gas with a heat content of only about 90 BTU per standard cubic foot due to the high percentages of useless gases, nitrogen and carbon dioxide, with the highest percentage being nitrogen from injected air.

Methanization of Coal

Since coal is hydrogen deficient compared to petroleum and natural gas, additional hydrogen is required to increase the methane content of exit gases. By increasing working pressures in the reaction zone, increasing percentages of carbon in the form of methane occur. In experiments in Great Britian over 20 years ago the proportion of carbon appearing as methane was 14.4% at 10 atmospheres and 22.2% at 40 atmospheres. Since it is advantageous to increase the methane content of exit gases for in situ gasification of coal, elevated pressures are required in the reaction zone. Overburden above the coal bed, a disadvantage in conventional coal mining, is an advantage for in situ gasification because it provides a seal to avoid hot gas blowouts to the surface.

Earlier Gasification Projects

The first large scale attempt to gasify coal began as a government subsidized program in Russia in 1931. Much of the Russian field work involved substantial underground workings, preparing chambers underground, digging inlet and and outlet shafts, fire drifts, and the like. The advent of World War II with massive disruptions in normal trade channels coupled with partial successes with the Russian project generated interest in other countries and initiated new projects that continued into the post war years. Major projects were conducted in Great Britain, Russia, Poland, Italy, Belgium, Czechoslovakia, France, Morocco and the United states. All projects were characterized by a low calorific value of the produced gas (on the order of 100 BTU per standard cubic foot.) This common characteristic stemmed from lack of control of inlet air underground resulting in inlet air bypassing the reaction or burning zone and proceeding to the exit area where unplanned burning of methane, hydrogen, and carbon monoxide occurred before withdrawal. Other problems with these projects included gas leakage, water encroachment, unplanned subsidence of the coal formation, and wide variations and fluctuations in the calorific content of the produced gas.

OBJECTS OF THE INVENTION

It is an object of the present invention to recover a substantial amount of the calorific content of coal in situ by gasifying the coal and producing the coal for industrial and commercial purposes.

It is another object of the present invention to provide a method and apparatus for in situ gasification of coal which maximizes the methane, carbon monoxide, and free hydrogen content of the produced gas.

It is another object of the present invention to provide a method and apparatus for in situ gasification of coal which minimizes the free nitrogen and carbon dioxide content of the produced gas.

It is another object of the present invention to provide a method and apparatus for in situ gasification of coal wherein directional control of injected gasifying agents are obtained to avoid undesired burning of useful gases near the produced gas outlet.

It is another object of the present invention to provide a method of in situ gsification of coal wherein gas leakage channels in the coal bed are plugged to control the burning of the bed and the recovery of the desired gases.

It is another object of the present invention to provide a method of in situ gasification of coal wherein underground water encroachment is controlled.

It is another object of the present invention to provide a method of in situ gasification of coal wherein underground burning is controlled for planning subsidence of the coal formation.

It is another object of the present invention to provide a method and apparatus for in situ gasification of coal which unifies the calorific content of the produced gases.

It is another object of the present invention to provide an apparatus for in situ gasification of coal wherein the resultant generated heat is captured for use separately from the produced gas.

It is another object of the present invention to provide an apparatus for in situ gasification of coal wherein a heat absorbent fluid is circulated through a heat transfer coil in direct exposure to produced gas whereby the heat of the gas is transferred to the fluid which is removed from the gasification site separately from the produced gas,

SUMMARY OF THE INVENTION

The method of the present invention is primarily concerned with controlling the input of gasifying agents into a coal bed such that the gasifying agents are delivered to the burning face of the coal bed and not allowed to facilitate continued burning of the produced gas which lowers the calorific content of the produced gas. A further feature of the method of the invention includes the step of exposing the hot produced gas to a heat absorbent fluid during the removal from the coal bed so that the fluid absorbs heat from the produced gas and can be used separately from the produced gas in generating other forms of energy.

The apparatus of the present invention which is used in carrying out the method of the invention, consists in one embodiment of a well bore in communication with the coal bed so that the gasifying agents can be pressure fed into the conduit and emitted from the open end of the conduit within the coal bed at a desired velocity sufficient to deliver the gas directly to the burning face of the coal bed. In another embodiment of the apparatus, rupturable containers of the gasifying agents are deposited or dropped into the coal bed through a suitable well bore such that the containers can roll along an inclined surface of the coal bed to the burning face of the bed where the intense heat of the burning bed ruptures the containers thereby releasing the gasifying agents therein at the desired location.

With either of the disclosed apparatus, the gasifying agents are released or caused to be delivered directly to the burning face of the coal bed so that the calorific content of the produced gas can be reliably controlled by limiting the combustion of the coal bed and the produced gas.

In one preferred form of the invention, a fluid circulation line is positioned in direct exposure to the hot produced gas so that the heat in the produced gas can be transferred to the circulating fluid in the line and piped to a suitable plant for commercial use such as for example, in the generation of electricity.

DESCRIPTION OF THE PREFERRED EMBODIMENTS

Figure 1:
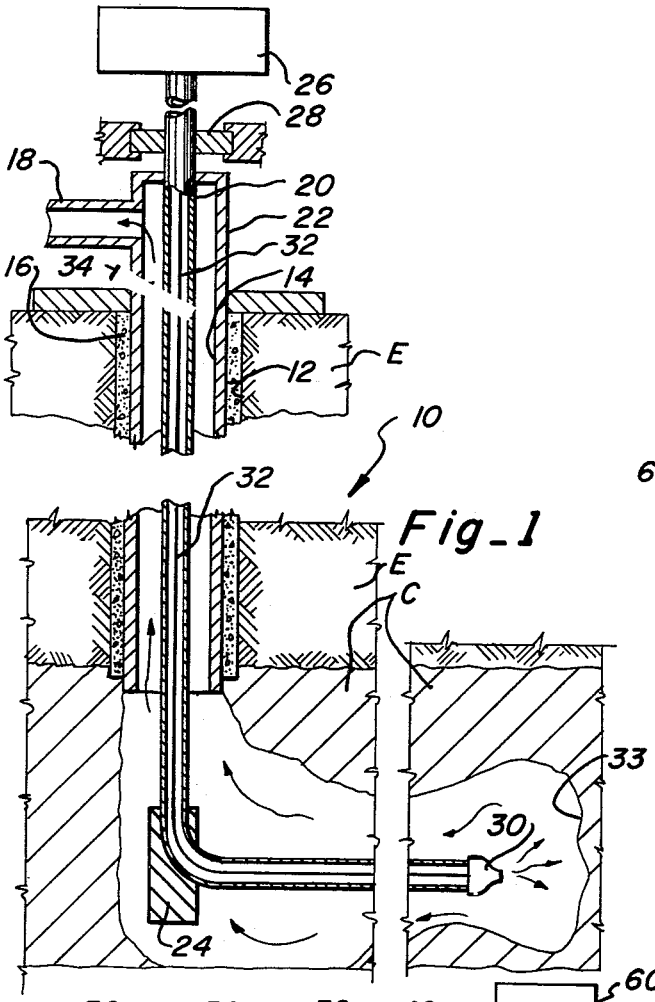
FIG. 1 is a fragmentary diagramatic view of one embodiment of the apparatus of the present invention.

As a preliminary to a detailed description of the method and apparatus of the present invention, it should be appreciated that in in situ gasification of coal, two important forms of energy are released:

1. A gas with a calorific or BTU content, and,
2. heat which can be converted to various forms of energy in a number of conventional ways.

Accordingly, the present invention is concerned in one aspect with recovering gases with high BTU or calorific content and in another aspect with capturing the heat generated from the gasification process for use in the production or generation of other forms of energy. Depending upon the objectives of the particular gasification process, i.e. recovering gas with a high BTU content, capturing heat from the gasification process, or both, different reactants or gasifying agents are used for controlling the gasification process. Further, the pressure at which the gasification process is carried out also has a direct bearing on the BTU content of the gas removed and the heat generated from the process.

As will be appreciated, in any combustion process the presence of oxygen is necessary and the more oxygen the more readily the combustive process will take place. Accordingly, in a coal gasification process if it is desired to excessively burn the coal bed, e.g. for high heat recovery, abundant amounts of oxygen are fed to the burning coal bed. However, if it is desired to recover gas with a high BTU content, the amount of oxygen supplied to the burning coal bed must be limited and controlled so that incomplete combustion is effected. To provide effective incomplete combustion and to methanize a portion of the coal, it is necessary to establish a proper reaction zone where the reactants can be intimately associated at the appropriate temperatures and pressures. In this invention, the reactants may be hydrogen and carbon from the coal; moisture in the coal; additional water in the form of ambient water, super heated water under pressure, steam, or water vapor (either injected or a product of a reaction); oxygen in the form of gas, liquid, as derived from a reaction, or from air; any other means for providing oxidation in the reaction; or additional hydrogen either injected or as a product of a reaction. Except for solid coal, all reactants herein mentioned for purposes of the present disclosure are individually and collectively termed gasifying agents.

There is a wide selection of sources of oxygen available for use in this invention. Oxygen in liquid form is preferable to gaseous form because the liquid is easier to direct to the reaction zone. In either case the oxygen will be in gaseous form when it becomes a reactant. The oxygen content of air is an inexpensive source requiring only compression of injection purposes, but has the disadvantage of generating large quantities of nitrogen in the produced gas. Oxygen from water is an excellent reactant with incandescent coal (coke) since hydrogen is also released in the reaction, but has the disadvantage when used in too large quantities of quenching the reaction. Pure oxygen in liquid or gaseous form is ideal when it is controlled for proper incomplete combustion but pure oxygen is less economical than the other readily available forms. Among the many other sources of oxygen, one is worthy of special note, and that is aqueous ammonium nitrate. As the temperature is increased above ambient, ammonium nitrate ($NH_4NO_3$) enters a reversible reaction releasing ammonia ($NH_3$) as a gas and nitric acid ($HNO_3$) as a gas. Gaseous nitric acid is a potent oxidizer. Much of the oxidizer advantage is lost however, if ammonium nitrate suddenly reaches decomposition temperature and pressure where the ultimate reaction is:

$$NH_4NO_3 \rightarrow N_2 + 2H_20 + 1/20_2$$

The selection of one or more oxidizers for this invention is a compromise between cost of the oxidizer and facility of control to the reaction zone so that no particular amount of oxygen can be herein defined as preferable since it is dependent upon the type of coal bed, it's location, etc.

Referring to FIG. 1, a first embodiment of the present invention is shown which is designed to gasify coal in situ in such a manner that high BTU content gas can be recovered. The apparatus 10 illustrated in FIG. 1 is adapted to be inserted into a well bore 12, e.g. 20 inches in diameter in the earth E which is equipped with a liner 14, e.g. 16 inches in diameter, which is cemented into place as with a casing 16 to seal off water bearing strata and to protect the hole from cave-ins. The liner 14 is in fluid communication with an exit pipe 18 and has an hermetically sealed opening 20 through which a flexible injection tube or conduit can be inserted. The apparatus 10 includes a flexible conduit 22, a whip stock 24, through which the conduit passes within the coal formation C to control the direction in which the conduit is pointed within the coal bed, a conventional "Christmas Tree" — pump combination 26 which is of the type used in the petroleum industry, and a gas tight bearing 28 which cooperates with the Christmas Tree to serve as a hanger for the injection conduit 22 while permitting rotation of the conduit. Since the Christmas Tree — pump combination 26 is conventionally used in the petroleum industry, a detailed description and illustration is not deemed necessary. Suffice it to say that the Christmas Tree — pump combination is equipped with mechanism for injecting reactants into the injection conduit 22 at desired pressures.

The leading end of the injection conduit 22 has a nozzle 30 mounted thereon preferably with a gimbal type connector (not shown), the nozzle being used to concentrate the emission of the reactants and to direct them in a preselected direction as may be determined by the orientation of the whip stock 24 and of the nozzle itself relative to the injection conduit. The orientation of the nozzle relative to the conduit could be controlled by any suitable commercially available means such as hydraulic, pneumatic or electronic systems operated from the surface and which have operational hoses 32 or the like extending through the conduit to the nozzle. It will thus be appreciated that with this apparatus, the nozzle 30 on the leading end of the injection conduit 22, can be advanced horizontally away from the lower end of the well bore 12 by extending the conduit further into coal formation and can also be angularly oriented by rotating the conduit with the bearing 28, whip stock 24 and by moving the nozzle relative to the conduit whereby injected reactants can be directed in any given direction into the coal formation from a surface location. It is critical to complete control of the gasification process that the injected reactants be directly exposed to the burning face 33 of the coal bed and that the oxygen content of the reactants not be allowed to be exposed to the produced combustible gas as the presence of oxygen would allow the continued burning of the gas which would lower the BTU content of the recovered gas.

To begin the gasification process with the apparatus 10, illustrated in FIG. 1, a reaction zone in the coal bed at the bottom of the well bore is pressurized to the desired operating pressure. This pressure is preferably above the hydraulic waterhead at the elevation of the coal bed so as to prevent the ingress of migrant water into the coal bed during the gasification process. The particular pressure, however, must be determined for each gasification site since excessive pressure may force the produced gases into unburned portions of the coal formation which have natural permeability. High pressures are otherwise desirable for optimum methane recovery since, as was mentioned previously, it has been found that the proportion of recovered gas appearing as methane increases with the existing pressures. Pressures must be controlled to some extent, however, since excessive pressure in a relatively shallow coal bed could cause the earth to erupt from the high pressure, thereby destroying the sealed pressurized gasification chamber and endangering the individuals carrying on the gasification process. After the reaction zone at the bottom of the well bore has been desirably pressurized, the coal is ignited in place using techniques commonly used by the petroleum industry for in situ combustion in petroleum fire floods. A working chamber is burned out using oxygen injection, for example air or oxygen enriched air, with the produced gas saved or vented to the atmosphere. Injection pressures are preferably maintained at low levels, for example 15 psig, until the initial chamber is established. The desired reactants are then injected under pressure into the injection conduit 22 and emitted from the nozzle 30 at or near the burning face of the coal bed so that the oxygen increases the burning at the face of the coal bed but allows the produced gas to escape without overburning whereby the produced gas has a desirable high BTU content.

As mentioned previously, if the produced gas is allowed to completely burn, the calorific content of the produced gas approaches zero negating any benefit from the gasification process. Accordingly, the nozzle 30 is maintained as close as possible to the burning face of the coal bed and when it is not possible to position the nozzle adjacent to the burning face of the coal bed, the nozzle is pointed in the desired direction for burning and the velocity with which the reactants are injected into the coal bed is increased so that the reactants travel a greater distance upon leaving the nozzle and can thereby be delivered to the burning face of the coal bed to maintain combustion. As mentioned previously, controlled combustion is necessary for the recovery of optimum BTU gas since an over burning will permit the carbon monoxide to be converted to carbon dioxide which is inert, for the hydrogen to burn into water vapor, and for the methane to burn into carbon dioxide and water, each of which is inert.

In the early stages of the gasification process, an appreciable quantity of produced gas will be lost to the formation due to mine pressure forcing the gas through the natural permeability of the coal in place. Gas losses, however, will diminish as the process proceeds due to migration of hot tars and ash produced in the process. The tars and ash tend to follow gas flow into the formation, become cooled at a distance from the reaction zone, and thus seal the permeable channels.

The working chamber is enlarged in the direction or directions planned, by controlling the direction and the velocity of injected gasifying agents. In one mining plan a reaction tunnel is formed by directing the gasifying agent injection with gradually increasing velocities without changing directions. The oxidizer may be injected continuously in pulsating slugs, or alternating with slugs of water or steam, or hydrogen, depending on the plan for exit gas content. Also, several reaction tunnels may be formed by rotating the injection line to planned positions and injecting the gasifying agents at timed intervals. The remote control of the nozzle, as previously described, provides control for planned gasifying agent injection. In these various modes the coal bed is gasified by burning from the bottom upward, driving off volatile elements for exit through the annulus 34 of the well together with gas from the products of incomplete combustion. By locating these tunnels at the base of the coal bed at appropriate positions, for example every 60° of injection line rotation, sufficient unburned coal may be left in place to avoid catastrophic subsidence of the coal bed that can block the injection paths of the gasifying agent and shear well liners.

Figure 2:
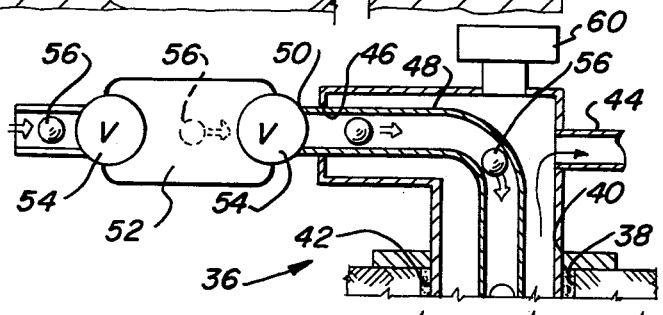
FIG. 2 is a fragmentary diagramatic view of a second embodiment of the apparatus of the present invention.

Referring to FIG. 2, a second embodiment of the present invention, is illustrated which is also designed for recovering high BTU gas in an in situ coal gasification process. The apparatus 36 shown in FIG. 2 is specifically adapted for use with coal beds which have a dip so that they incline relative to horizontal. As in the first described embodiment, a well bore 38 is drilled from a surface location to the top of the coal bed C and a liner 40 is cemented in place as with a casing 42. The liner 40 has an outlet pipe 44 in fluid communication therewith for removing produced gas from the gasification location. The liner also has an hermetically sealed opening 46 through which an injection tube 48 is positioned so that the injection tube opens through the lower end of the liner in direct communication with the coal bed. The inlet end 50 of the injection tube is in fluid communication with a pressure lock 52 which has suitable valves 54 at either end to allow containers 56 of gasifying agents to be inserted into the injection tube which is pressurized as previously described in relation to the first described embodiment. The pressure lock 52 serves to bridge the pressure differential existing between the ambient environment where the containers 56 are inserted into the system and the well bore which is maintained at a higher pressure for optimum gas recoveries. The containers 56 for the gasifying agents could be of any suitable type but in the preferred form are spherical in configuration so that they can be dropped into the coal bed C′ and roll along the inclined bed until they reach the burning face of the coal bed.

The containers could be made of ceramic, light metal or plastic as long as they are designed to rupture at the approximate burning temperature of the face of the coal bed which would be approximately 3000° F. As the containers rupture with the intense heat, they will release the gasifying agents at the face 58 of the coal bed to concentrate the burning at the face of the bed and not near the exit from the formation where the produced gases are allowed to escape. The well in this embodiment would be equipped with a Christmas Tree — pump combination 60 or other similar equipment so that the pressure within the reaction zone could be maintained as desired.

It will be appreciated that with either of the embodiments shown in FIGS. 1 and 2, an injector well-producer well concept could be incorporated by utilizing two wells in reasonably close proximity to each other. One well would serve as an injection location for the gasifying agents and the other as a removal location for the produced gas. Their roles, of course, could be reversed as desired during an in situ gasification program. In a normal production sequence, there would be a number of wells, some operating at peak efficiency, some approaching peak efficiency, some approaching their economic limit, new wells being drilled and equipped, and the like. With a multiplicity of wells and by blending the output of all producers, a uniformity of produced gas could be achieved. Of course, with the injector well-producer well concept, one well would be used to inject the gasifying agent into the reaction zone of the coal formation and the pressure in the reaction zone would force the gas through the natural permeable channels of the coal formation so that they could be removed from the removal well which would be adjacent to the injection well. This of course has the advantage of immediately removing the produced gas from the burning coal beds to prevent the overburning of the gas thereby providing for the recovery of high BTU gas.

Figure 3:
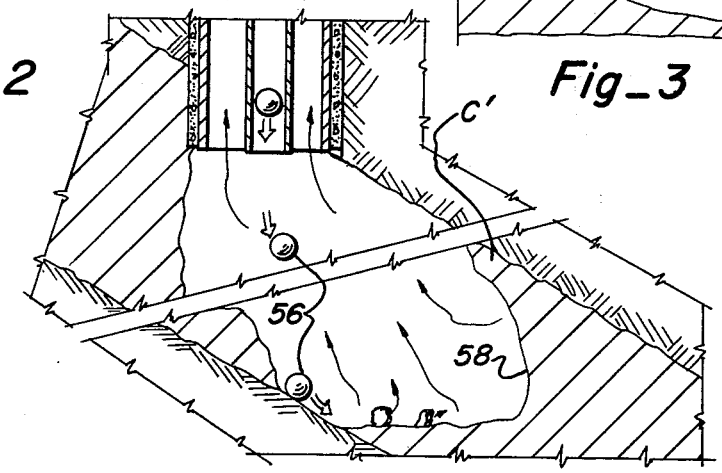
FIG. 3 is a diagramatic fragmentary view of a third embodiment of the apparatus of the present invention adapted to recover heat generated in the gasification process.
Figure 3:
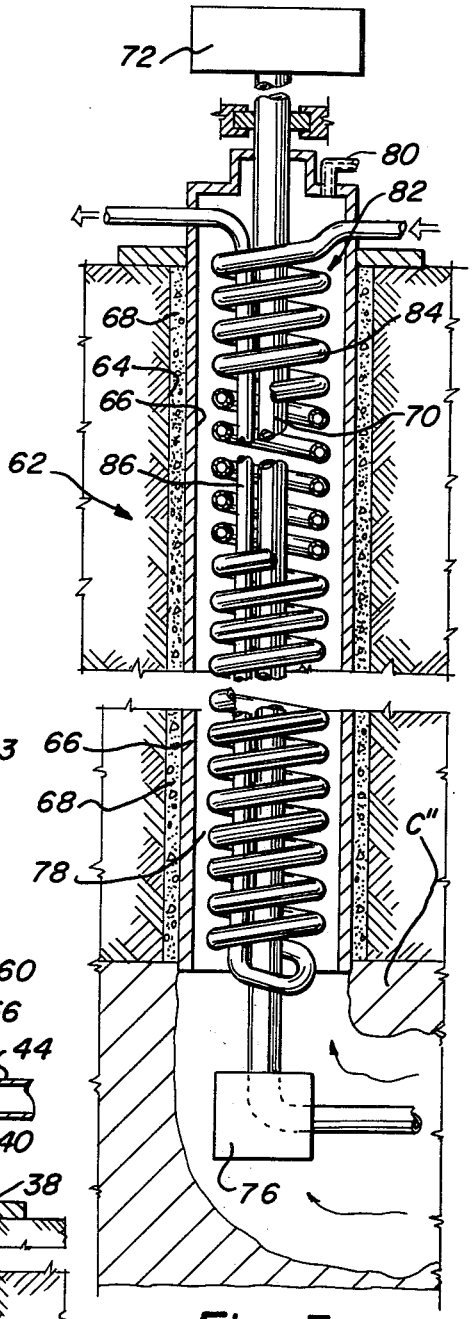

As mentioned previously, the embodiments of the invention disclosed in FIGS. 1 and 2 are designed for recovering gas from the coal which has an optimum BTU content. However, as also previously mentioned, the produced gas in the gasification process leaves the reaction zone at a very high temperature and the heat content of this gas could be used to produce other forms of energy such as electricity, or the like. The embodiment of the present invention illustrated in FIG. 3 is designed and adapted to not only gasify coal in accordance with the procedure set forth in the description of the apparatus 10 of FIG. 1, but to also capture the heat produced in the process so that this heat can be used separately from the produced gas in the production of usable energy. The apparatus 62 shown in FIG. 3 can be seen to be similar to the embodiment shown in FIG. 1 in that a well bore 64 is drilled from a surface location to the top of a coal bed C″ and a liner 66 cemented in place as with a casing 68. An elongated flexible injection conduit 70 is suspended in the liner 66 by a Christmas Tree pump combination 72 which has a rotatable bearing 74 cooperating therewith so that the conduit can be rotated within the liner. The lower end of the conduit may pass through a whip stock 76 which directs the leading end of the conduit away from the well bore toward the burning face (not shown) of the coal bed so that injected reactants can be delivered to the burning face of the coal bed for control of the combustion. As in the embodiment of FIG. 1, the produced gas migrates upwardly through the annulus 78 of the well and is removed therefrom through a removal pipe 80 at the top of the liner. In order to capture and remove the heat in the produced gas and transfer this heat to a different location for use in generating other forms of energy, such as electricity, a heat transfer system 82 is suspended within the liner. The heat transfer system 82 illustrated is in the form of a heat conductive helical coil fluid circulating line 84 which circumscribes the injection conduit along its length and has a vertical portion 86 which extends upwardly from the bottom of the coil in parallel relationship with the injection conduit 70. Both the inlet and outlet of the fluid circulating line 84 pass through the wall of the liner in sealed relationship therewith so that the pressure in the reaction zone can be maintained In operation, the reactants are injected into the reaction zone just as described in relation to the apparatus of FIG. 1 and as the produced gas is allowed to migrate upwardly through the liner to the removal pipe 80, a fluid such as water, is circulated through the circulating line 84 so that the heat conductive circulating line will rob heat from the escaping gas and transfer the heat to the fluid in the line 84 which is returned to the surface as a super-heated liquid under pressure or as a super heated gas. This hot liquid or gas is piped to a suitable plant (not shown) for conventional commercial use, for example, in the generation of electricity.

It will be appreciated that as the reaction chamber is enlarged and the BTU content of the exit gas diminishes below the economic limit for pipeline quality gas, for example, 85 BTU's per standard cubic foot, injection of the gasifying agents may be adjusted by injecting more oxygen so that complete combustion of the exit gas is obtained which of course generates the maximum heat. Prior to this point in the production cycle, each production well is producing both pipeline gas through the annulus of the well and hot fluid or hot gas from the circulating line. At this point in the production cycle, the production of pipeline gas is terminated and production continues with the hot fluid or gas. Such production may be continued to the depletion of coal available for combustion.

To those skilled in the art, it will be apparent that the use of a helical coil is but one example of a suitable means to capture the heat available in the exit gas of coal burning in situ. While it is preferred to make the heat transfer underground, such transfer of useful heat may also be accomplished by delivering the hot exit gas to appropriate facilities above ground.

It should be appreciated that with the methods and apparatus of the present invention, heat can be obtained from the earth in a manner which is superior to the prior art "hit and miss" type of approach which has previously been used in drilling for geothermal wells which are used as a commercial source of heat. It will also be appreciated that the methods and apparatus disclosed hereinbefore could be used in the in situ combustion of underground mines which have not been completely mined. In this case, gasifier injection lines would be layed in the workings of the mine at suitable locations so that in situ combustion could be carried out according to plan, with injection lines continuing to surface facilities. Interconnected heat transfer coils could be installed in one or more shafts with the exit gas pipes also installed in one or more shafts and a suitable seal, for example a concrete plug, placed in all openings to the surface. The coal would be ignited and injection of gasifying agents continued as the mine was brought up to operating pressure. Produced gas could be withdrawn for commercial purposes as in the previously described embodiments and the fluid circulated through the coils returned to the surface as a superheated fluid for commercial use. Planned subsidence is attained by the planned injection of gasifying agents, with the preferred plan being to burn the coal first at the greatest distance from the produced gas exits. In situ combustion continues, in the preferred plan, toward the produced gas exits until coal available for combustion is depleted.

The raw gas produced from any of the processes hereinbefore described, will contain particulate matter which should be removed before the gas is used commercially. This removal is accomplished by the use of standard equipment commonly used for the same purpose in applications where coal is burned at the surface, for example as boiler fuel. Fly ash recovered in this step may have further commercial use due to its pozzolanic properties for addition to concrete mixtures. The gas also contains hot tars and volatile components that may be removed as higher value products of in situ gasification of coal. These are removed in standard facilities commonly used with the well known Lurgi process of aboveground gasification of coal. Some of the products removed in this manner include carbon dioxide, ammonia, benzene, toluene, zylene, phenol, naphthalene, pyridene and the like.

During in situ gasification of coal in accordance with any of the aforedescribed methods of the present invention, the produced gas is monitored to determine the BTU content thereof. By monitoring the content of the produced gas, efficiencies of the process can be adjusted. For example, an increase in carbon dioxide content of the produced gas would indicate over burning so that the oxidizer injection would be reduced or the point of release of the oxidizer moved into a closer location to the burning face of the coal bed so that the produced gases would not be overburned and would, therefore, have a higher BTU content upon removal. By careful monitoring and adjusting of the content and flow of gasifying agents, the produced gas should have a BTU per standard cubic foot in the range of 250–800.

Although the present invention has been described with a certain degree of particularity, it is understood that the present disclosure has been made by way of example and that changes in details of structure may be made without departing from the spirit thereof.

What is claimed is:

1. A process for in situ gasification of coal comprising the steps of:

establishing a passage of fluid communication between a surface location and a sub-surface coal formation, inserting a flexible conduit into the passage so that it opens into the coal formation, establishing an hermetic seal between the coal formation and the above surface ambient environment, igniting the coal formation, injecting gasifying agents through the conduit to sustain the burning of the coal formation, releasing the gasifying agents at the receding burning face of the coal formation by increasing the extent to which the conduit extends into the formation so that the conduit opens at the burning face, and capturing the gaeous products emitted from the burning coal.

2. Apparatus for in situ gasification of a sub-surface coal formation linked to a surface location by an open passage comprising in combination, means for establishing an hermetic seal between the coal formation and the surface location, flexible conduit means extending through the passage to the coal formation, a nozzle secured to the lower end of the conduit, control means operable from the surface extending through the conduit means for manipulating the orientation of the nozzle within the coal formation whereby gasifying agents can be injected through the conduit and nozzle into the coal formation to sustain burning of the formation, and means for capturing gas released from the buring coal formation.

3. A process for in situ gasification of coal comprising the steps of:

establishing a passage of fluid communication between a surface location and a sub-surface coal formation, inserting a flexible conduit into the passage so that it opens into the coal formation, establishing an hermetic seal between the coal formation and the above surface ambient environment, igniting the coal formation, injecting gasifying agents through the conduit to sustain the burning of the coal formation, increasing the velocity of the gasifying agents as they are injected into the coal formation so that they are delivered directly to the receding burning face of the coal deposit, capturing the gaseous products emitted from the burning coal, and reducing the oxygen content of the gasifying agents as the BTU content of the captured gaseous products decreases.

4. A process for in situ gasification of coal comprising the steps of:

establishing a passage of fluid communication between a surface location and a sub-surface coal formation, inserting a flexible conduit into the passage so that it opens into the coal formation, establishing an hermetic seal between the coal formation and the above surface ambient environment, igniting the coal formation, keeping sub-surface water out of the formation by maintaining the formation pressure above the water head pressure at the formation, injecting gasifying agents through the conduit to sustain the burning of the coal formation, increasing the velocity of the gasifying agents as they are injected into the coal formation so that they are delivered directly to the receding burning face of the coal deposit, and capturing the gaseous products emitted from the burning coal.

* * * * *